US007300257B2

(12) United States Patent
Lifson et al.

(10) Patent No.: US 7,300,257 B2
(45) Date of Patent: Nov. 27, 2007

(54) PREVENTION OF UNPOWERED REVERSE ROTATION IN COMPRESSORS

(75) Inventors: Alexander Lifson, Manlius, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 318 days.

(21) Appl. No.: 11/017,304

(22) Filed: Dec. 20, 2004

(65) Prior Publication Data

US 2006/0222510 A1 Oct. 5, 2006

(51) Int. Cl.
*F04B 49/06* (2006.01)

(52) U.S. Cl. ..... 417/44.1; 417/53; 418/55.1; 418/55.6

(58) Field of Classification Search ..... 418/55.1, 418/55.6; 417/44.1, 53
See application file for complete search history.

(56) References Cited

U.S. PATENT DOCUMENTS 5,006,045 A * 4/1991 Shimoda et al. ..... 417/42
5,156,539 A * 10/1992 Anderson et al. ..... 418/55.4
5,167,491 A 12/1992 Keller, Jr. et al.
5,220,259 A * 6/1993 Werner et al. ..... 318/432
5,246,349 A * 9/1993 Hartog ..... 417/371
5,320,507 A * 6/1994 Monnier et al. ..... 418/55.6
5,772,403 A 6/1998 Allison et al.
5,820,349 A 10/1998 Caillat
6,042,344 A 3/2000 Lifson
6,210,119 B1 * 4/2001 Lifson et al. ..... 417/18
6,893,227 B2 * 5/2005 Weng ..... 417/12

* cited by examiner

*Primary Examiner*—Hoang Nguyen
(74) *Attorney, Agent, or Firm*—Marjama Muldoon Blasiak & Sullivan LLP

(57) ABSTRACT

The shutdown of a compressor (10) installed in a refrigerant circuit (2) in air conditioning or refrigeration system is controlled so as to prevent unpowered reverse rotation of the compressor. Prior to terminating electric power to the compressor drive motor (24), the pressure within the system is relieved and substantially equalized across the compressor, thereby eliminating the possibility of unpowered reverse rotation of the compressor at shutdown. Pressure relief and equalization may be achieved by reducing the operating speed of the compressor to a low forward speed for a period of time prior to deenergizing the compressor drive motor. Pressure equalization may also be achieved by driving the compressor in reverse rotation prior to deenergizing the drive motor.

23 Claims, 2 Drawing Sheets

PREVENTION OF UNPOWERED REVERSE ROTATION IN COMPRESSORS

TECHNICAL FIELD

The present invention relates generally to compressors having a shaft driven in rotation by a drive motor, including for example scroll compressors and screw compressors, and more particularly, to a method of operating such compressors at shutdown to prevent unpowered reverse rotation.

BACKGROUND OF THE INVENTION

In air conditioning and refrigeration systems, a compressor is provided to compress a refrigerant and pass that refrigerant through the refrigerant circuit and system components such as a condenser, an evaporator and an expansion device. Scroll compressors and screw compressors are widely used in such air conditioning and refrigerant systems. In both scroll compressors and screw compressors, the refrigerant is compressed as it passes through compression elements associated with a compressor shaft driven in rotation by a drive motor. As the compressor shaft is driven in rotation, the refrigeration passes through progressively smaller compression pockets defining the compression chamber of the compression mechanism. In a screw compressor, the compression mechanism consists of a spiral screw mounted to the compressor shaft and having a screw flight that in association with a surrounding casing defines a progressively compacting compression chamber. In a scroll compressor, the compression mechanism consists of a pair of co-acting scroll members, each scroll member having a generally spiral wrap which interfits with the wrap of the other member to define a compression chamber therebetween. One of the scroll members orbits relative to the other upon rotation of the compressor shaft such that the size of the compression chamber defined between the scroll wraps progressively narrows to compress the refrigerant captured therein.

A shortcoming of such compressors is that, on shutdown, unpowered reverse rotation frequently occurs. It has been general practice to initiate shutdown of the compressor by abruptly terminating electric power to the drive motor. Upon terminating electric power to the motor, the motor no longer applies drive torque to the compressor shaft. Reverse rotation results when compressed refrigerant vapor re-expands from the refrigerant circuit downstream of the compressor discharge port back through the compression chamber to the suction side of the refrigerant circuit upstream of the compressor suction port. As the refrigerant re-expands through the compression chamber, the force of the re-expanding refrigerant drives the unpowered compression mechanism in reverse rotation. The reverse rotation will cease when the pressure between compressor discharge and compressor suction has equalized or nearly equalized.

Such unpowered reverse rotation is undesirable as it can cause damage internal to components of the compressor. Further, unpowered reverse rotation produces an undesirable noise that can be disturbing and annoying to the user of the air conditioning or refrigeration system or can be mistakenly associated with compressor failure. Prior steps to prevent unpowered reverse rotation have generally involved designing an additional component into the compressor such as an internal check valve that closes when the compressed refrigeration vapor begins to re-expand from the compressor discharge back through the compression chamber. When this internal check valve closes, the back flow of the compressed vapor is physically blocked, thus at least minimizing duration of the unpowered reverse rotation or eliminating it. However, the addition of an extra component to the compressor increases the cost of the compressor. Further, the risk exists that the check valve might fail during operation.

Unpowered reverse rotation may also be prevented by including a bypass valve, such as a solenoid or the like, that selectively opens to divert at least a portion of the backflow refrigerant vapor directly to suction thereby bypassing all or at least a portion of the compression mechanism. For example, U.S. Pat. No. 6,042,344 of Lifson discloses a scroll compressor having an unloader bypass valve. At, or shortly before, shutdown, the unloader bypass valve is opened to allow the compressed refrigerant to pass from an intermediate compression stage directly to the compressor suction line, thereby bypassing at least a portion of the compression mechanism. In U.S. Pat. No. 5,167,491, Keller and Chaump disclose a compressor having a dedicated valve installed in a bypass line between the compressor discharge line and the compressor suction line. At, or shortly before, shutdown of the compressor, the valve is opened to allow the compressed refrigerant to pass from the compressor discharge line through the bypass line directly to the compressor suction line, thereby bypassing the compression mechanism altogether. In each of these arrangements, unpowered reverse rotation is thus eliminated or substantially reduced. However, in each of these arrangements, additional components are typically required. Also, some refrigerant may still pass through the compression mechanism.

SUMMARY OF THE INVENTION

The shutdown of a compressor is controlled so as to prevent unpowered reverse rotation of the compression mechanism of the compressor. Prior to terminating electric power to the compressor drive motor, the pressure on the discharge (high) side of the compressor is substantially equalized to the pressure on the suction (low) side of the compressor, thereby eliminating the possibility of unpowered reverse rotation of the compression mechanism at shutdown.

In one aspect of the present invention, the method for controlling the shutdown of a compressor includes the steps of: initiating the shutdown of the compressor by reducing the rotational speed of the compressor to a low forward speed; operating the compressor at said low forward speed for a period of time sufficient enough to substantially equalize pressure on the discharge side to the pressure on the suction side of the compressor, and thereafter de-energizing the compressor drive motor.

In another aspect of the present invention, the method for controlling the shutdown of a compressor includes the steps of: initiating the shutdown of the compressor by transitioning from driving the compressor shaft in the forward direction to driving the compressor shaft in a reverse direction, i.e. powered reverse rotation, and de-energizing the compressor drive motor when the compressor drive shaft is rotating in the reverse direction after pressure on the discharge side is substantially equalized to the pressure on the suction side of the compressor. It should be noted that in contrast to unpowered reverse rotation, powered reverse rotation is normally not damaging to the compressor internal components and does not produce substantial noise.

DESCRIPTION OF THE DRAWINGS

For a further understanding of the present invention, reference should be made to the following detailed description of a preferred embodiment of the invention taken in conjunction with the accompanying drawings wherein.

DESCRIPTION OF THE PREFERRED EMBODIMENT

Figure 1:
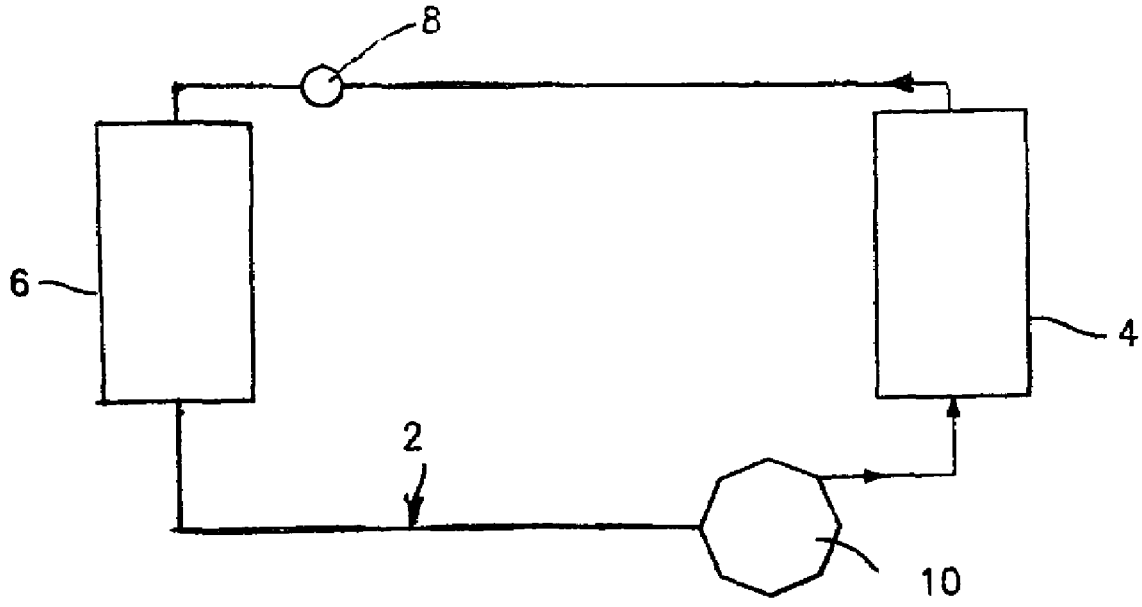
FIG. 1 is a schematic representation of an air conditioning or refrigeration system.

Referring now to FIG. 1, the present invention will be described herein with respect to a compressor installed in a refrigerant circuit 2, such as commonly found in an air conditioning, heat pump or refrigeration systems, having a condenser 4, an evaporator 6, an expansion valve 8 and a compressor 10 connected in the conventional manner in refrigerant flow communication by refrigerant lines so as to form the refrigerant circuit 2. It is to be understood, however, the present invention is not limited in application to compressors installed in air conditioning, heat pumps or refrigeration systems, but may be applied to any compressor subject to unpowered reverse rotation upon shutdown due to the re-expansion of compressed fluid back through the compression mechanism. In particular, although the present invention will be described herein with respect to a scroll compressor, it may be applied to a screw compressor and any other compressor subject to unpowered reverse rotation upon shutdown. Furthermore, as known to a person ordinarily skilled in the art, a basic vapor compression system shown in FIG. 1 may have additional features and numerous configuration variations. For instance, these modifications may include, but are not limited to, economizer branch, reheat loop, design extension for heat pump alterations, and the like.

Figure 2:
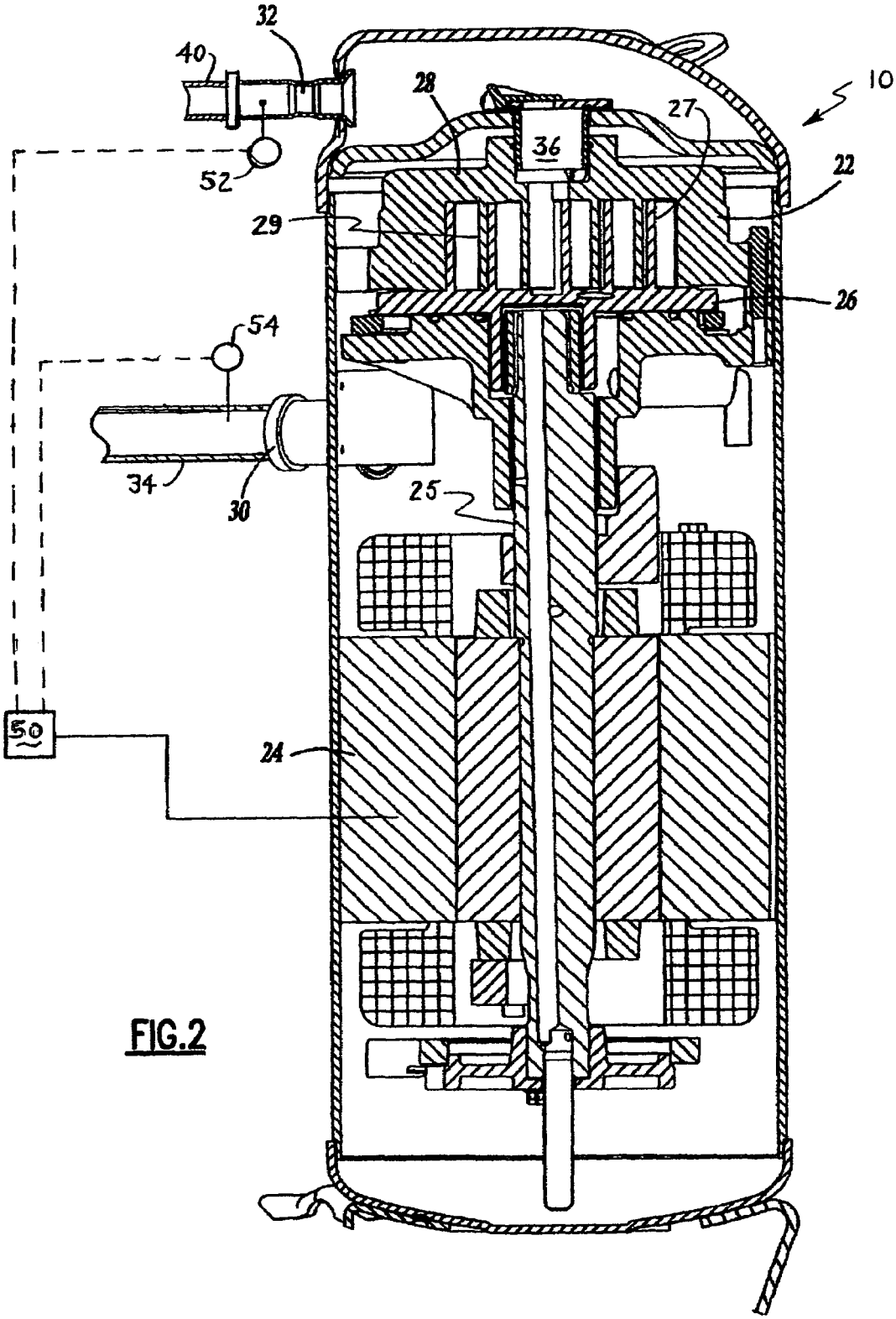
FIG. 2 is an elevation view of a scroll compressor.

Referring now to FIG. 2, there is depicted therein a scroll compressor 10 having a compression mechanism 22 and an associated drive motor 24. The compression mechanism 22 includes an orbiting scroll member 26 and a non-orbiting scroll member 28. The scroll members 26 and 28 have respective wraps 27 and 29 extending outwardly from their respective bases. The wraps 27 and 29 interfit in a conventional manner to define compression pockets therebetween to entrap volumes of fluid during the compression process. Although described herein with respect to a scroll compressor, it is to understood that the present invention may be applied to screw compressors and any other compressors subject to unpowered reverse rotation upon shutdown due to the re-expansion of compressed fluid back through the compression mechanism.

The orbiting scroll member 26 is operatively mounted to a drive shaft 25 in a conventional manner. The drive shaft 25 is driven in rotation in a forward direction by the drive motor 24 upon providing electrical power to the drive motor 24. In response to the rotation of the drive shaft 25 in the forward direction, the orbiting scroll member 26 moves in an orbital movement relative to the non-orbiting scroll member 28 to provide compression of the refrigerant fluid entrapped within the compression mechanism 22. A motor controller 50 is provided in operative association with the drive motor 24 and controls operation of the compressor drive motor 24 in response to commands received from a system controller (not shown) associated with the air conditioning or refrigerating system in which the compressor is installed.

The scroll compressor 10 includes a suction inlet 30 and a discharge outlet 32. Refrigerant from suction line 34, which forms part of the refrigerant circuit 2 and is connected to an upstream component, typically an evaporator 6, of the air conditioning or refrigeration system, not shown, enters the compressor 20 through the suction inlet 30 and passes to the compression mechanism 22. Compressed refrigerant leaves the compression mechanism 22 through the discharge port 36 and passes out of the compressor 20 through discharge outlet 32 into a discharge line 40 through which the compressed refrigerant is delivered to a downstream component, typically a condenser 4, of the air conditioning or refrigeration system.

The orbital action of the orbiting scroll member 26 displaces the refrigerant spirally inward through the compression pockets formed between the interfitting scroll members 26 and 28 of the compression mechanism 22 to the discharge outlet 32, while progressively reducing the volume of the compression pockets thereby compressing the fluid trapped therein.

Instead of abruptly terminating the supply of electric power to the drive motor to shutdown the compressor, the present invention provides a method for controlling the shutdown of the compressor to prevent unpowered reverse rotation. In accord with one aspect of the present invention, shutdown is initiated by reducing the forward rotational speed of the drive shaft 25 from its normal operational speed under load to a relatively slow forward rotational speed. When shutdown is desired, the motor controller 50 controls the drive motor 24 to reduce the rotational speed of the drive shaft 25 to a desired relatively slow forward speed. As the rotational speed of the drive shaft is reduced, the orbital speed of the orbiting scroll member is reduced proportionally. The compressor is operated at this relatively slow forward rotational speed for a period of time sufficient enough to substantially equalize the pressure across the compression mechanism, and therefore throughout the system, that is, until the pressure of the discharge side of the compressor is substantially equalized to the pressure on the suction side of the compressor. When the compressor is operated at a sufficiently slow forward speed, no compression occurs within the compression mechanism 22. Additionally, the interfitting scroll members 26 and 28 may separate when operated below a certain speed thereby creating a relatively large gap between the scroll members through which the compressed fluid within the compression pockets will vent directly to the interior of the compressor which is exposed to suction pressure and/or to intermediate pressure, in case the compressor is equipped with an intermediate compression port.

The period of time of operation at slow forward rotational speed sufficient to achieve pressure equalization will be relatively short, typically between 5 and 45 seconds. Thereafter, the motor controller 50 terminates the supply of electric power to the drive motor 24. As the pressure within the system and the compression mechanism has been equalized prior to deenergizing the drive motor, unpowered reverse rotation will not occur. It will be understood by persons of ordinary skill in the art that the particular operating speed and the time interval at slow speed operation is partially determined by limitations of the lubrication system of the compressor. If the speed of the drive shaft is too low, lubrication may be inadequate. The particular speed for low speed operation and the period of time for low speed operation may be preset in the motor controller 50 to a desired length.

In accord with another aspect of the invention, shutdown is initiated by reversing the direction of rotation of the drive shaft 25, which in turn results in a reversal of the direction of rotation of the orbiting scroll member. When shutdown is desired, the motor controller 50 controls the drive motor 24 to transition the drive shaft 25 from rotation in the forward direction to powered rotation in the reverse direction. In operation, compression only occurs within the compression mechanism 22 when the drive shaft 25 is rotated in the forward direction. When the drive shaft 25 rotates in the reverse direction, the orbiting scroll member is driven in reverse rotation, which results in the fluid within the compression elements being rapidly passed back to suction pressure until the pressure across the compression mechanism is substantially equalized, that is until the pressure on the discharge side is substantially equalized to the pressure on the suction side of the compressor. Thus, pressure within the air conditioning or refrigeration system is also rapidly equalized. The motor controller 50 terminates the supply of electric power to the drive motor 24 shortly after powered reverse rotation has occurred as refrigerant pressures within the compression mechanism 22 and the system are rapidly equalized. Upon deenergizing the drive motor 25, unpowered reverse rotation will not occur since the pressure within the system and compression mechanism 22 has been equalized prior to deenergizing the drive motor 25. The particular speed for reverse rotation operation and the period of time for reverse speed operation may be preset in the motor controller 50 to a desired speed and length.

Alternatively, in either method aspect of the present invention, the period of time for low speed operation or reverse rotation may be selected by the motor controller 50 in response to the measured pressure differential between compressor discharge and compressor suction pressures. For example, a sensor 52 may be provided for sensing the refrigerant pressure on the discharge side of the compressor 10 and providing a signal indicative of the sensed discharge pressure to the motor controller 50 and a sensor 54 may be provided for sensing the refrigerant pressure on the suction side of the compressor 10 and providing a signal indicative of the sensed suction pressure to the motor controller 50. Upon receipt of the command to initiate shutdown, the motor controller 50 will monitor the signals from the sensors 52 and 54 during low speed operation or reverse rotation, as the case may be, and deenergize the drive motor 25 when the sensed discharge pressure and the sensed suction pressure are substantially equalized, that is within a preselected acceptable differential that is preprogrammed into the motor controller 50. It has to be understood that an intermediate pressure, that is a refrigerant pressure greater than suction pressure and less than discharge pressure, for example in the case of an economized compressor, may be utilized instead of a suction pressure, or other equivalent parameters that have a direct relationship to system pressures. For example, saturation suction and saturation discharge temperatures, may be measured by providing a sensor that senses refrigerant saturation temperature on the discharge side of the compressor, and a sensor that senses refrigerant saturation temperature on the suction side of the compressor, and adequate programming of the controller 50.

The method of the present invention may be advantageously applied in connection with the shutdown of variable speed or multi-speed compressors. When applied to variable speed compressors, the motor controller may be programmed to control the motor drive to reduce the forward rotational speed of the drive shaft through a preprogrammed path to the desired lower speed or to transition the drive shaft to powered rotation in the reverse direction whenever a shutdown is initiated. When applied to a multi-speed compressor, the motor controller may be preprogrammed to control the motor drive to step the speed of the drive shaft from the full load operating speed to the lowest forward rotational operating speed or appropriate reverse speed whenever a shutdown is initiated.

Although the present invention has been described and illustrated with respect to the afore-described embodiments, other embodiments will occur to those skilled in the art. For example, the benefits of both embodiments described herein may be realized, by reducing the forward speed of the compressor to a relatively low forward speed and thereafter driving the compressor in reverse rotation. It is therefore intended that the scope of the present invention is to be limited only by the scope of the appended claims.

What is claimed is:

1. A method of operating a compressor for a controlled shutdown, the compressor having a drive shaft operatively associated with a compression mechanism having a compression chamber wherein a fluid is compressed from a suction pressure to a discharge pressure upon rotation of the drive shaft, and a drive motor operatively associated with the drive shaft for driving the drive shaft at a rotational speed, said method comprising controlling rotation of the drive shaft to substantially equalize the discharge pressure to the suction pressure prior to deenergizing the drive motor.

2. A method of operating a compressor for a controlled shutdown as recited in claim 1 wherein controlling rotation of the drive shaft comprises the steps of:

initiating the shutdown of the compressor by reducing the rotational speed of the drive shaft to a low forward speed;

operating the compressor at said low forward speed for a period of time sufficient to substantially equalize the discharge pressure to the suction pressure.

3. A method of operating a compressor for a controlled shutdown as recited in claim 2 further comprising operating the compressor at a predetermined low forward speed for a predetermined period of time prior to deenergizing the compressor drive motor.

4. A method of operating a compressor for a controlled shutdown as recited in claim 2 further comprising:

sensing a compressor suction pressure and sensing a compressor discharge pressure during the period of low speed operation;

comparing the sensed discharge pressure to the sensed suction pressure; and deenergizing the compressor drive motor when the sensed discharge pressure is substantially equalized to the sensed suction pressure.

5. A method of operating a compressor for a controlled shutdown as recited in claim 2 further comprising:

sensing a compressor intermediate pressure and sensing a compressor discharge pressure during the period of low speed operation;

comparing the sensed discharge pressure to the sensed intermediate pressure; and deenergizing the compressor drive motor when the sensed discharge pressure is substantially equalized to the sensed intermediate pressure.

6. A method of operating a compressor for a controlled shutdown as recited in claim 2 further comprising:

sensing a compressor saturation suction temperature and sensing a compressor saturation discharge temperature during the period of low speed operation;

comparing the sensed saturation discharge temperature to the sensed saturation suction temperature; and deenergizing the compressor drive motor when the sensed saturation discharge temperature is substantially equalized to the sensed saturation suction temperature.

7. A method of operating a compressor for a controlled shutdown as recited in claim 1 wherein controlling rotation of the drive shaft comprises the steps of:

initiating the shutdown of the compressor by transitioning from driving the drive shaft in the forward direction to driving the drive shaft in a reverse direction;

operating the compressor in said reverse direction for a period of time sufficient to substantially equalize the discharge pressure to the suction pressure; and de-energizing the compressor drive motor after the drive shaft is rotating in the reverse direction.

8. A method of operating a compressor for a controlled shutdown as recited in claim 7 further comprising operating the compressor at a predetermined reverse speed for a predetermined period of time prior to de-energizing the compressor drive motor.

9. A method of operating a compressor as recited in claim 7 further comprising:

sensing a compressor suction pressure and sensing a compressor discharge pressure during the period of reverse rotation operation;

comparing the sensed discharge pressure to the sensed suction pressure; and deenergizing the compressor drive motor when the sensed discharge pressure is substantially equalized to the sensed suction pressure.

10. A method of operating a compressor as recited in claim 7 further comprising:

sensing a compressor intermediate pressure and sensing a compressor discharge pressure during the period of reverse rotation operation;

comparing the sensed discharge pressure to the sensed intermediate pressure; and deenergizing the compressor drive motor when the sensed discharge pressure is substantially equalized to the sensed intermediate pressure.

11. A method of operating a compressor as recited in claim 7 further comprising:

sensing a compressor saturation suction temperature and sensing a compressor saturation discharge temperature during the period of reverse rotation operation;

comparing the sensed saturation discharge temperature to the sensed saturation suction temperature; and deenergizing the compressor drive motor when the sensed saturation discharge temperature is substantially equalized to the sensed saturation suction temperature.

12. A compressor comprising:

a compression mechanism;

a driven shaft operatively associated with a compression mechanism whereby a fluid is compressed upon rotation of the of the driven shaft in a forward direction;

a drive motor operatively associated with the driven shaft for driving the driven shaft; and a controller operative to initiate the shutdown of the compressor by reducing the rotational speed of the driven shaft to a low forward speed and operating the compressor at said low forward speed for a period of time sufficient to substantially equalize the discharge pressure to the suction pressure, and thereafter deenergizing the drive motor.

13. A compressor as recited in claim 12 wherein the compressor is a scroll compressor.

14. A compressor as recited in claim 12 wherein the compressor is a screw compressor.

15. A compressor as recited in claim 12 wherein the compressor is a variable speed compressor.

16. A compressor as recited in claim 12 wherein the compressor is a multi-speed compressor.

17. A compressor as recited in claim 12 wherein the compressor is installed in one of an air conditioning, a heat pump system, or a refrigeration system.

18. A compressor comprising:

a compression mechanism;

a driven shaft operatively associated with a compression mechanism whereby a fluid is compressed upon rotation of the of the driven shaft in a forward direction;

a drive motor operatively associated with the driven shaft for driving the driven shaft; and a controller operative to initiate the shutdown of the compressor by transitioning the drive shaft from rotation in the forward direction to rotation in a reverse direction, operating the compressor in said reverse direction for a period of time sufficient to substantially equalize the discharge pressure to the suction pressure, and de-energizing the compressor drive motor after the compressor drive shaft is rotating in the reverse direction.

19. A compressor as recited in claim 18 wherein the compressor is a scroll compressor.

20. A compressor as recited in claim 18 wherein the compressor is a screw compressor.

21. A compressor as recited in claim 18 wherein the compressor is a variable speed compressor.

22. A compressor as recited in claim 18 wherein the compressor is a multi-speed compressor.

23. A compressor as recited in claim 18 wherein the compressor is installed in one of an air conditioning system, a heat pump system, or a refrigeration system.

* * * * *